340-552 SR
XR 4,063,230

United States Patent [19]
Purinton et al.

[11] 4,063,230
[45] Dec. 13, 1977

[54] BALANCED FIELD THEFT DETECTION SYSTEM

[75] Inventors: Edwin C. Purinton, Oreland; Carl S. Holzinger, Coopersburg; Robert Auger, Lansdale, all of Pa.

[73] Assignee: The Magnavox Company, Fort Wayne, Ind.

[21] Appl. No.: 586,333

[22] Filed: June 12, 1975

[51] Int. Cl.[2] ..... G08B 13/24
[52] U.S. Cl. ..... 340/280; 324/232; 340/258 C; 324/233
[58] Field of Search ..... 340/280, 258 R, 258 C; 324/41

[56] References Cited

U.S. PATENT DOCUMENTS

| | | | |
|---|---|---|---|
| 3,559,201 | 1/1971 | Hilliard | 340/258 R |
| 3,665,449 | 5/1972 | Elder et al. | 340/280 |
| 3,686,564 | 8/1972 | Mallick et al. | 340/258 C X |
| 3,696,379 | 10/1972 | Minasy | 340/280 |
| 3,697,972 | 10/1972 | Brown | 340/258 C X |
| 3,763,424 | 10/1973 | Bennett et al. | 340/258 C X |
| 3,818,472 | 6/1974 | Mauk | 340/280 |
| 3,868,669 | 2/1975 | Minasy | 340/258 C X |
| 3,911,389 | 10/1975 | Mills | 340/258 C X |

*Primary Examiner*—Glen R. Swann, III
*Attorney, Agent, or Firm*—Thomas A. Briody; Frank R. Trifari; William J. Iseman

[57] ABSTRACT

Apparatus and method for identifying the presence in a pre-established location of an object having preselected electrical or magnetic properties. By applying two periodically varying electro-magnetic fields of the same frequency to the pre-established location, the presence of the object is determined by unique perturbations of the electro-magnetic fields produced by the object. The applied electro-magnetic field is generally nonuniform in the pre-established location to maximize the interaction between the object and the electro-magnetic field. A pick-up coil is utilized to sense the resulting field perturbations. A magnetometer can be optionally incorporated in a sensing system to inhibit erroneous indications produced by magnetic objects.

11 Claims, 3 Drawing Figures

BALANCED FIELD THEFT DETECTION SYSTEM

This invention relates generally to the control or identification of the passage of an object having preselected properties through a location interrogated by monitoring apparatus. A more particular application of the invention involves the detection of marker tags including materials having preselected electrical or magnetic properties, which can be attached to articles of merchandise.

The marker tags can be removed from the articles of merchandise by authorized persons prior to passage through the interrogated location. Thus, the apparatus should discriminate between concealed articles of merchandise with coupled marker tags and other objects which can produce spurious signals in the monitoring apparatus.

It is known in the prior art to control the unauthorized removal of articles from an area by attaching special marker tags to the articles. The marker tags, when subjected to an electro-magnetic field, provide a detectable perturbation in the electro-magnetic field. All articles leaving a controlled area are channeled through an interrogation location surrounded by electro-magnetic field generating apparatus and field perturbation detecting apparatus. The detection of a perturbation of the electro-magnetic field unique to the marker tag provides an indication that an article and the coupled marker tag are passing through the interrogation location.

The use of electro-magnetic fields at an interrogation location is especially attractive because the interaction of the fields with the marker tags can take place even when the marker tags are concealed.

In order to ensure that the marker tags are conveniently small in size, greater sensitivity has been designed into detection apparatus. However, greater sensitivity of the detection apparatus results in an increase of susceptability of the detection apparatus to effects of external field producing sources as well as permitted removal of articles of merchandise containing certain materials. The sensitivity of the detection system must in general be limited so that the field perturbing effects from sources other than the marker tag can be distinguished from the field perturbing effects of a marker tag. Otherwise, these other sources may make it appear that a tag is present when it is not. In the retail sales environment, where the consequences of an erroneous marker tag identification can result in customer dissatisfaction or even potential legal consequences, the full detection capabilities of prior art systems have been compromised.

A further problem found in prior art theft detection systems has been the result of utilization of substantially uniform fields. In the uniform field environment, certain marker tag orientations were undetectable by the prior art apparatus because the normally strong interaction between the marker tag and the electro-magnetic field occurs only for specific tag orientations in the electro-magnetic field.

An additional problem in prior art systems arose in the presence of large ferrous objects. Large ferrous objects can produce perturbations in the electro-magnetic field which are similar to perturbations caused by the marker tag, and far in excess of the strength of field perturbations needed to activate the detection apparatus. Ferrous objects in the vicinity of the detection apparatus could either initiate spurious signals or could override the smaller field perturbation produced by a marker tag.

The present invention overcomes many of the disadvantages of prior art systems. A curved magnetic field is provided by the geometric and electrical relationships between transmitting coils and the receiver coils. The curved magnetic field provides high detectability of practically all orientations of a detector or marker tag that may pass through the magnetic field. In addition, the phase and amplitude of the signal picked up by the receiver coil are compared and must be in a predetermined range to distinguish between spurious signals and signals having a characteristic different from one produced by the detector or marker tag. Also a magnetometer is used to detect the presence, within the magnetic field, of a large ferrous object and thereby inhibit an alarm. The present invention is intended to generate an alarm indication only when one of the detector or marker tags is within the magnetic field.

It is therefore an object of the present invention to provide increased sensitivity in apparatus for detecting field perturbing effects wherein applied electro-magnetic fields produce substantial cancelling effects in the absence of a perturbing object.

It is another object of the present invention to provide a nonuniform applied electro-magnetic field in a system for detecting objects by perturbation of the applied field, wherein the nonuniform magnetic field minimizes the non-detectability of an object because of an unfavorable spatial orientation.

It is another object of the present invention to provide a detection system for an object with preselected electrical or magnetic properties including apparatus for measurement of both amplitude and phase quantities of an electro-magnetic perturbation resulting from a presence of the object.

It is yet another object of the present invention to provide detection apparatus for identifying perturbation of an electro-magnetic field caused by an object having preselected electrical or magnetic properties, wherein field perturbation detection apparatus is disabled in the presence of a spurious field from a large magnetic object.

SUMMARY OF THE INVENTION

In carrying out the above and other objects of the invention in one form, we provide a marker tag having preselected electrical or magnetic properties, apparatus for producing an electro-magnetic field, balanced field detection apparatus which produces substantially zero output signal in the absence of any perturbing objects, and apparatus for sensing the character of any signals produced by the presence of an electro-magnetic field perturbing object.

The apparatus for detecting signals incorporates apparatus for measuring a quantity related to the amplitude of the electro-magnetic field perturbation and a quantity related to the phase shift of the perturbed electro-magnetic field component. Upon detection of an amplitude and a phase shift having predetermined values, apparatus is enabled to indicate the presence of a specific perturbing object. The method used to distinguish between different conductive or magnetic materials is the different amplitude and phase of the magnetic field perturbations produced by each of the different materials. Thus, the apparatus can detect a specific material being used as a marker tag in protecting articles of merchandise.

The set of apparatus producing the electro-magnetic fields are disposed relative to each other so that the resultant field is spatially nonuniform.

Apparatus is provided to disable the detection circuits in the event of a large field perturbation produced by a magnetic object.

The subject matter which we regard as our invention is set forth in the appended claims. The invention itself, however, together with further objects and advantages thereof, may be better understood by referring to the following detailed description taken in conjunction with the accompanying drawings.

The exemplifications set out herein illustrate the preferred embodiments of the invention in one form thereof, and such exemplifications are not to be construed as limiting in any manner.

DESCRIPTION OF THE PREFERRED EMBODIMENT

Figure 1:
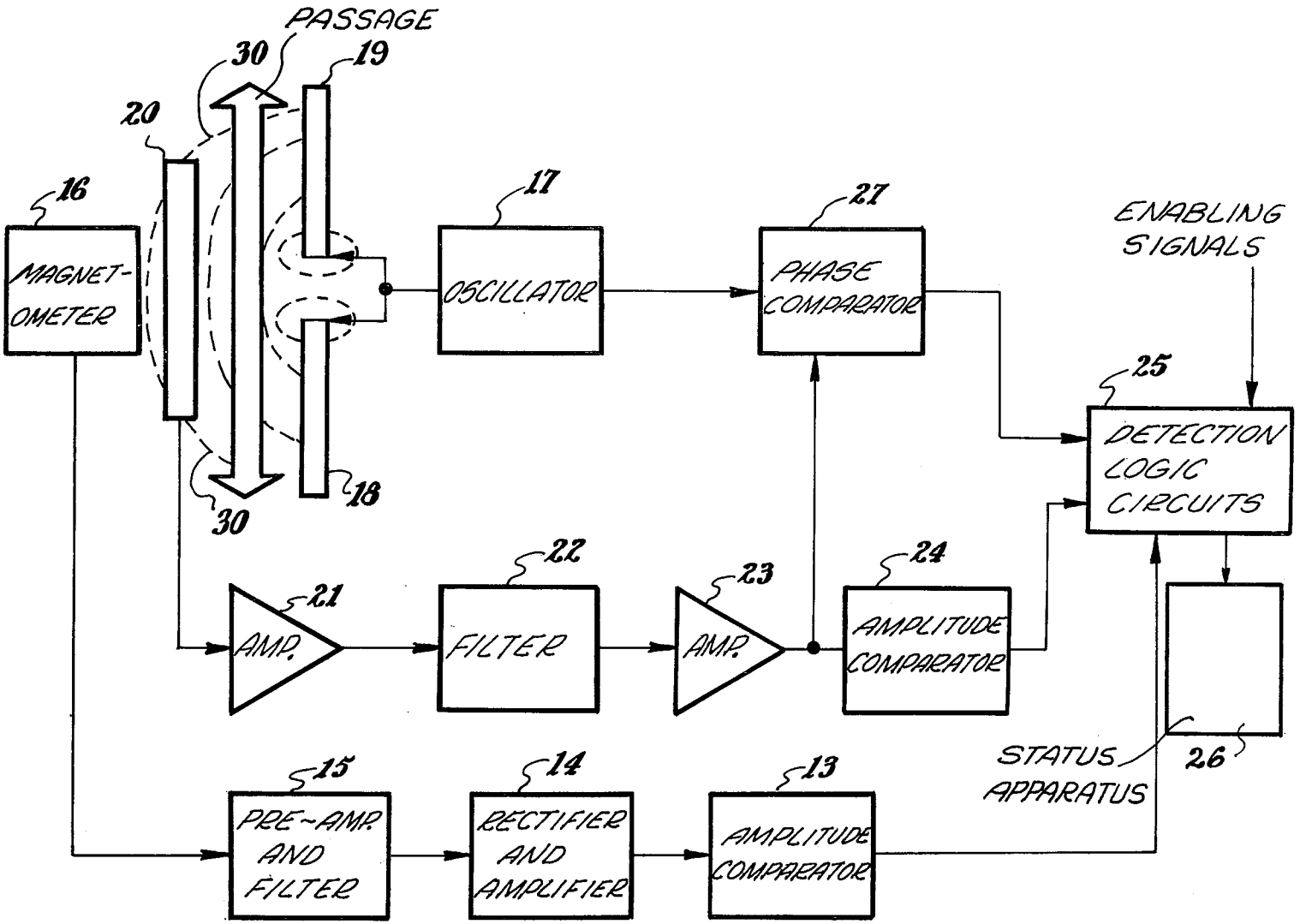
FIG. 1 is a schematic block diagram of apparatus for detecting objects having preselected electro-magnetic field perturbing properties according to the present invention.

Referring now to FIG. 1, a marker tag detection device according to the present invention is shown. Oscillator 17 applies a sinusoidal current to two substantially identical electro-magnetic field producing units 18 and 19. The field producing units can be similarly constructed conducting coils. The lines of the magnetic field produced by the coils are indicated schematically by lines 30 in FIG. 1.

Any perturbations in the fields produced by units 18 and 19 are detected by field detector unit 20. Detector unit 20 can be a coil in which the time varying fields induce a voltage. In the absence of a field perturbing object generally disposed between one of the field producing units 18, 19 and the field detector unit 20, the field producing units are arranged to producing cancelling effects in detector unit 20.

The signals produced by detector unit 20 are amplified by amplifier 21. The output signal of amplifier 21 is filtered by filter 22. Filter 22 provides a means of eliminating many detected spurious signals at frequencies differing from the electro-magnetic field frequency produced by units 18 and 19 and therefore provides a narrow band signal of the desired frequency. The output of filter 22 is amplified by amplifier 23 to provide a sufficient signal level to drive both phase comparator 27 and amplitude comparator 24.

The output signal of amplifier 23 is applied to an amplitude comparator circuit 24. When the output signal of amplifier 23 is between predetermined values, a positive logic signal is applied to detection logic circuits 25.

The output of amplifier 23 is also applied to phase comparator circuit 27. The phase of the amplifier 23 output signal is compared with the phase of oscillator 17. When the phases of the two signals differ by a predetermined value, a positive logic signal is applied to detection logic circuits 25. The simultaneous presence of the amplitude-related and the phase-related logic signals are necessary to activate the detection logic circuits.

A magnetometer 16 is placed in the vicinity of the electro-magnetic field producing units and the detector unit. An output signal from the magnetometer 16 is amplified, filtered, and rectified in pre-amplifier and filter circuits 15 and in rectifier and amplifier circuits 14. The output signal of amplifier 14 is applied to amplitude comparator 13. Amplitude comparator 13 compares the fields detected by magnetometer 16 with a predetermined level. The presence of a ferrous object producing a large field is detected by the magnetometer, and an inhibit signal is then applied to logic circuit 25, thereby disabling application of an activate signal to the status apparatus 26.

Upon application of the proper positive logic signals to logic circuits 25, an activate signal is applied to status apparatus 26. Status apparatus 26 can be a visual display of the status of the logic circuit 25 or can be apparatus producing an audible alarm signal.

Figure 2:
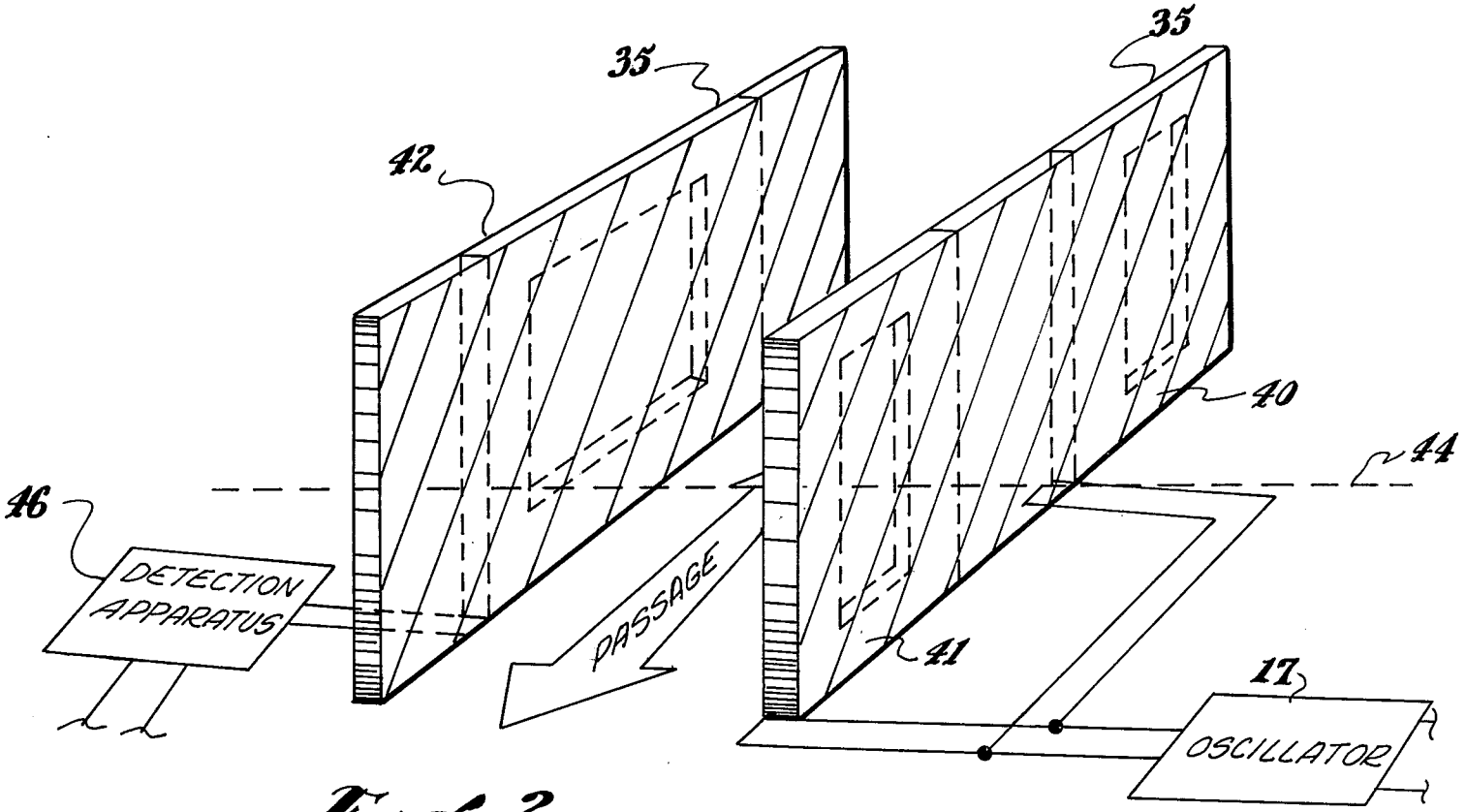
FIG. 2 is a perspective view of one arrangement for field producing and field detection units at an exit station of a theft detection system.

Referring next to FIG. 2, a perspective view is shown for an arrangement, according to the preferred embodiment, of the apparatus when the field producing units and the field detecting unit are coils. The field-producing coils 40 and 41 and the field detecting coil 42 are typically contained within facades 35. The facades are separated to provide passage for all articles exiting from the control area. Coils 40 and 41 are substantially identical. Furthermore, coils 40 and 41 are located symmetrically with respect to coil 42. This is indicated schematically by the coil position relative to line 44.

The coils 40 and 41 are driven by oscillator 17, while the detection apparatus 46 is used to indicate the presence of a field perturbing object in the passage. An unbalanced electro-magnetic field causes a signal to be induced in coil 42 by the perturbing objects. In this arrangement either a thin gauge high conductive electrical conductor or a thin gauge special ferromagnetic material may be used as a marker or detector tag which would disrupt the electro-magnetic field thereby detecting any pilferage of an item having such marker or detector tag attached thereto.

Figure 3:
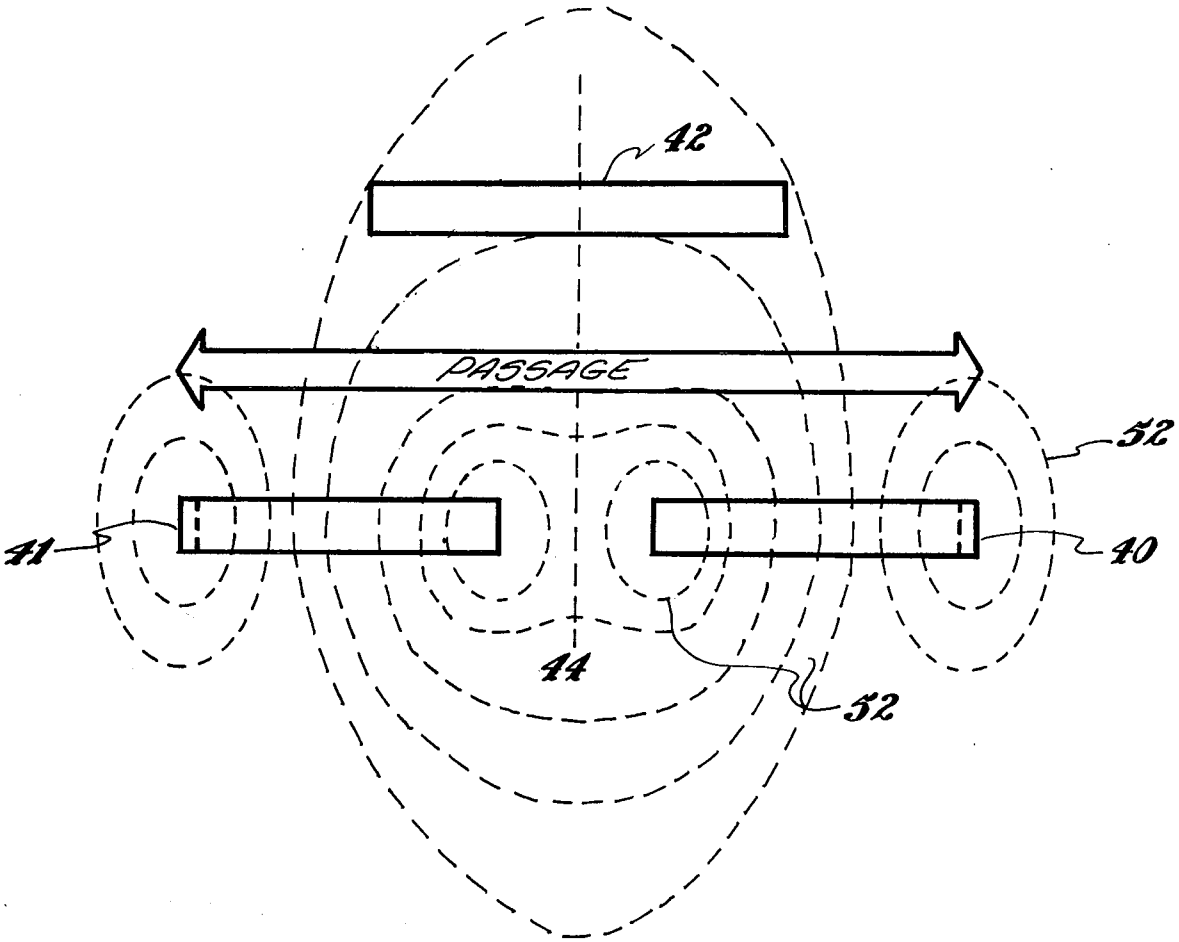
FIG. 3 is a top view of the field producing coils showing the curved field lines produced at an arbitrary instant in time.

Referring next to FIG. 3, a top view is shown of the electro-magnetic field lines 52 produced by field producing coils 40 and 41 at an instant in time. Unit 42 is the field detection coil. The electro-magnetic field lines 52 are shown in the unperturbed magnetic state. Also shown is the passage along which articles exiting from the control area are constrained to move.

In a preferred embodiment, objects with or without the marker tag are constrained to exit from the location for which control is sought, through the disclosed apparatus by a passage shown in FIGS. 1, 2 and 3. A normal operating procedure would involve the removal of marker tag from the article of merchandise by authorized personnel before exiting via the passage through the apparatus. The presence of a marker tag activates the status apparatus typically indicating the need for further inquiry into the cause of the activation.

The use of two substantially identical electro-magnetic field producing coils, symmetrically located with respect to a detection coil to produce cancelling induced signals, enhances the sensitivity of the detection coil to field perturbation caused by the passage of a marker tag. Furthermore, the two field producing coils can provide a substantial non-uniformity in the spatial disposition of the electro-magnetic field lines, thereby reducing the possibility of passage of an undetected marker tag in the passage. The spatial disposition of the electro-magnetic field prevents a marker tag from going undetected simply because of the orientation of the marker tag. As will be clear to those skilled in the art, the parallel orientation of the field-producing coils shown in FIGS. 1 and 2 is not necessary as long as the symmetrical orientation with respect to the field detection coil is maintained, so that the signals induced in the detection coils by the unperturbed electro-magnetic field will be substantially cancelled.

Furthermore, as will be clear to those skilled in the art, two non-symmetrical and non-generally identical coils can also be employed to produce cancelling effects in the detection coil although disposition of the coils will be more critical. In addition, because of the symmetry between field producing units and field detection unit, an oscillator can be used to drive the unit previously used to detect fields. Then the units previously used to produce the fields can be used to detect fields. While the effects of the fields no longer cancel in each coil, the two detection coils produce substantially identical output signals. By proper combination of the two output signals, a perturbation in the magnetic field will induce a signal that can be detected by the pair of coils.

In the preferred embodiment, two features have been included to provide greater discrimination against spurious field perturbation and identification of the passage of a marker tag. First, both the amplitude and the phase of the perturbing signal are monitored. Both quantities must lie in a predetermined range of values for activation of the status apparatus, thereby discriminating against spurious signals. As will be clear to those skilled in the art the predetermined range of values can be easily established by trial and error. The geometry and shape of the marker tag and the composition of the particular material resulting in the perturbation of the balanced electro-magnetic field, will determine the optimum values to discriminate against other field perturbing objects. Secondly, a magnetometer is used to disable activation of the alarm signals caused by the magnetic fields of large ferrous objects.

Consequently, while in accordance with the Patent Statutes, we have described what at present are considered to be the preferred forms of our invention, it will be obvious to those skilled in the art that numerous changes and modifications may be made herein without departing from the true spirit and scope of the invention, and it is therefore aimed in the following claims to cover all such modifications.

What we claim as new and desire to secure by Letters Patent of the United States is:

1. Apparatus for identifying a presence at a predetermined location of an object having preselected properties, comprising:

means for applying simultaneously at least two periodic electro-magnetic fields at said predetermined location, said periodic electro-magnetic fields forming a resultant curved electro-magnetic field, said preselected properties of the object producing a perturbation of said resultant curved electro-magnetic field when said object is within the predetermined location;

means for detecting said resultant curved electro-magnetic field, said detection means being arranged with respect to said resultant curved electro-magnetic field to provide a substantially null output signal when said resultant curved electro-magnetic field is unperturbed;

means for measuring an amplitude of an output signal of said detection means produced by a perturbation of said resultant curved electro-magnetic field;

means for measuring a phase of an output signal of said detection means relative to said resultant curved electro-magnetic field; and means for signaling said presence of said object when said amplitude measurement means and said phase measurement menas measure values within pre-established limits.

2. The object identification apparatus of claim 1, further including means for detecting a magnetic field with a same periodicity as the means for detecting the applied electro-magnetic field and producing an output signal disabling said means for signaling when said detected magnetic field exceeds a predetermined value.

3. The object identification apparatus of claim 1 wherein said resultant curved electro-magnetic field is nonuniform at said predetermined location.

4. The identification apparatus of claim 1 wherein said pre-established limits are established corresponding to a geometry of said object.

5. A theft detection system for identifying a presence of at least one preselected article at a predetermined location, comprising:

means for applying simultaneously at least two electro-magnetic fields having a given frequency to said predetermined location to produce a single curved electro-magnetic field;

means for detecting said curved electro-magnetic field wherein said means for detecting is located relative to said curved electro-magnetic field to provide generally a null output signal in an absence of substantial interaction with said curved electro-magnetic field disturbed by foreign materials;

means for detecting and measuring an amplitude of the output signal of said detecting means of the given frequency produced by a perturbation of said curved electro-magnetic field;

means for detecting and measuring a phase shift of the detecting means output signal of said given frequency produced by said perturbation of said electro-magnetic field; and means for signaling a perturbation of the applied electro-magnetic fields at said predetermined locations when said measured output signal amplitude and phase are within pre-established values.

6. The theft detection system of claim 5 further including means for measuring a magnetic field having said given frequency, wherein said means for measuring provides an output signal for disabling said signaling means when said magnetic field exceeds a predetermined value.

7. The theft detection system of claim 5 wherein said electro-magnetic field is spatially nonuniform in said predetermined location.

8. A method of selectively detecting objects at a predetermined location, said objects having a preselected interaction with electro-magnetic fields, comprising the steps of:

simultaneously applying at least two periodic electro-magnetic fields of the same frequency to said predetermined location said electro-magnetic fields producing a resultant curved electro-matic field;

locating an electro-magnetic field detector to provide a substantially null output signal in an absence of interactions with said resultant curved electro-magnetic field, wherein an article having an interaction with said resultant curved electro-magnetic field produces an output signal;

measuring an amplitude of said output signal produced by the article and said resultant curved electro-magnetic field interaction;

measuring a phase of said output signal produced by the article and said resultant curved electro-magnetic field; and providing an indication signal when said measured amplitude and phase produced by at least one of said objects being at said predetermined location are within predetermined limits.

9. The method of selectively detecting objects with preselected electro-magnetic field interactions of claim 8 further including the step of disabling said indication signal when an output signal of a magnetometer exceeds a pre-established value, said magnetometer being associated with said predetermined location.

10. Apparatus for selectively detecting a presence of one of a plurality of objects at a predetermined location, each of said objects having a substantially identical interaction with an electro-magnetic field, comprising:

means for simultaneously applying at least two electro-magnetic fields with a given frequency at said predetermined location, said electro-magnetic fields producing a resultant curved electro-magnetic field;

means for detecting an electro-magnetic field of said preselected frequency, wherein said detection means is located to provide a substantially null output signal when interactions with said resultant curved electro-magnetic field are substantially absent;

means for measuring an amplitude of said detector output signal;

means for measuring a phase of said detector output signal; and means for signalling a presence of at least one of said objects at said predetermined location when said output signal amplitude and phase are within preselected values, said preselected values determined by an interaction between said object and said resultant curved electro-magnetic field at said predetermined location.

11. Apparatus for selectively identifying a presence of one of a plurality of objects at a predetermined location of claim 10 further including:

a magnetometer for detecting magnetic field components, said magnetometer providing a disabling signal when said detected field components exceed a determined value; and means for disabling said signal means in response to said disabling signal.

* * * * *